United States Patent [19]

Akkerman et al.

[11] 4,062,406

[45] Dec. 13, 1977

[54] VALVE AND LUBRICATOR APPARATUS

[75] Inventors: Neil H. Akkerman, New Orleans, La.; Richard J. Ross, Houston, Tex.

[73] Assignee: Baker International Corporation, Orange, Calif.

[21] Appl. No.: 732,937

[22] Filed: Oct. 15, 1976

[51] Int. Cl.[2] ..... E21B 43/12

[52] U.S. Cl. ..... 166/323

[58] Field of Search ..... 166/319, 323

[56] References Cited

U.S. PATENT DOCUMENTS

| | | | |
|---|---|---|---|
| 3,696,868 | 10/1972 | Taylor, Jr. | 166/323 |
| 3,783,942 | 1/1974 | Mott | 166/323 |
| 3,886,967 | 6/1975 | Nelson | 166/323 |

*Primary Examiner*—James A. Leppink

*Attorney, Agent, or Firm*—William C. Norvell, Jr.

[57] ABSTRACT

A valve and lubricator apparatus are provided for installation of tools on wire line and the like for use in an oil or gas well while controlling fluids therethrough. The apparatus has valve means having a passageway therethrough for control of fluids through the apparatus. First fluid activatable means are provided for first shifting of the valve means to closed position. Second fluid activatable means also are provided for second shifting of the valve means to the open position. Means for locking the valve in closed position are provided to prevent shifting of the valve to open position by operation of the first fluid means. The second fluid means are operational to unlock the valve means from the closed and locked positions and to shift the valve to open position. The first and second fluid means and the locking means are repeatably and sequentially operational.

54 Claims, 15 Drawing Figures

Fig. 5C
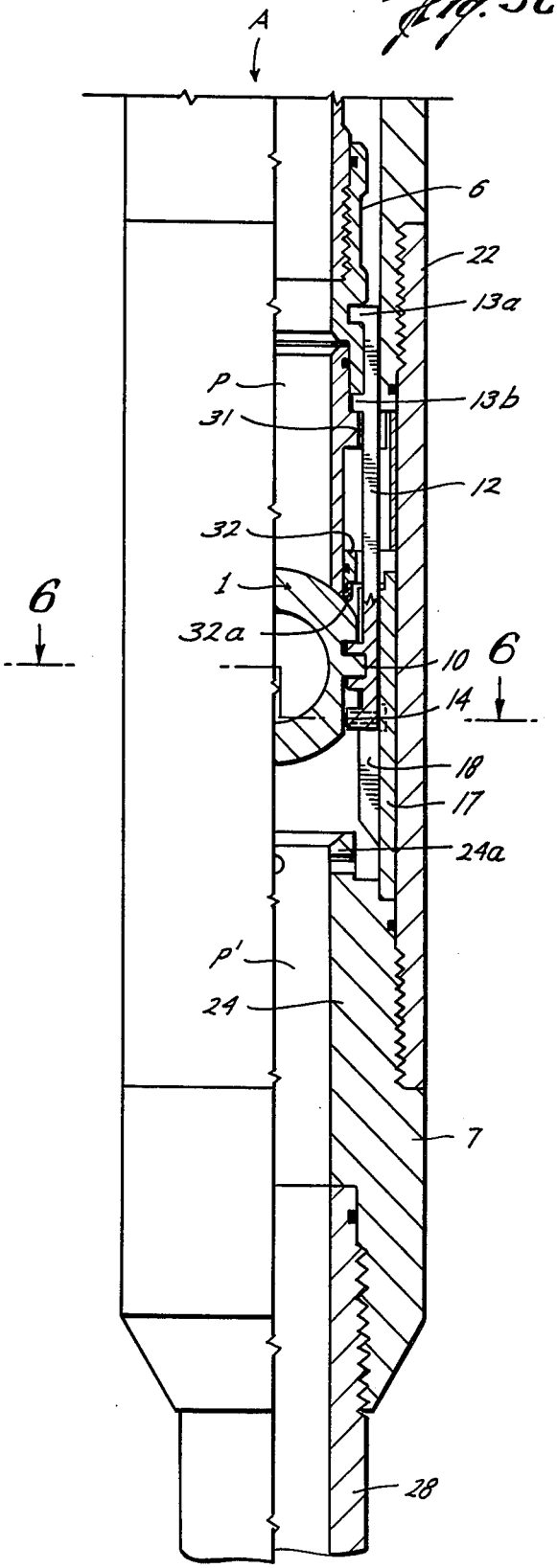
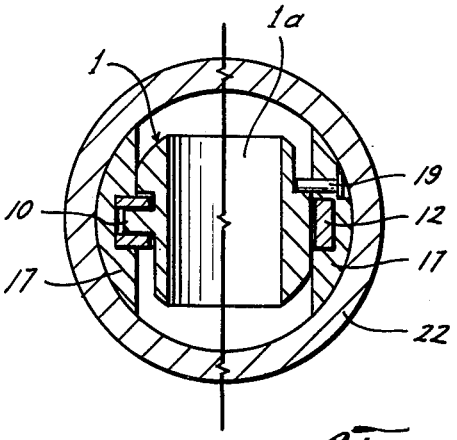
Fig. 6
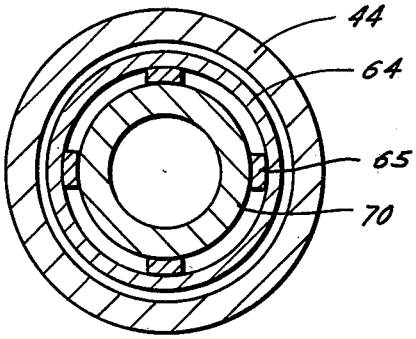
Fig. 7

VALVE AND LUBRICATOR APPARATUS

BACKGROUND OF THE INVENTION

1. Field of the Invention

This invention relates to a valve and lubricator assembly having particular utility on offshore locations in order to house a wire line or other tool while the shutoff valve and/or master or safety valve of the wellhead assembly are open. The present lubricator assembly when open functions as a pressure housing to permit a straight opening to the tubing therebelow or when closed, functions as a pressure barrier that allows installation of a wire line or other tools in a well in a safe manner.

2. Description of the Prior Art

During the completion, testing and/or workover of a subterranean well at an inland location, it may be necessary to run equipment such as a perforating gun or the like on a wire or electric line into the well when the well is under pressure. This is achieved by inserting the equipment into a length of production tubing above the christmas tree, the length of tubing being commonly referred to as a "lubricator". The lubricator section is isolated from the portion of the well therebelow by a valve or a series of readily accessable hand manipulated valves. On some inland locations, it may be necessary to extend the lubricator section as high as 60 feet into the air.

On offshore locations, where space is at a premium and valves are not readily accessable, an inland-type lubricator is not practical. For example, use of such an extended length of tubing may be hazardous when applied to an offshore well site utilizing a floating vessel thereabove. Relative motion between the floating vessel and the tubing string which is anchored in the well within the sea bed causes considerable difficutly in manipulation of manual valves.

Most offshore locations will utilize a riser pipe extending from the floating vessel to the ocean floor where it is connected to the uppermost portion of the blowout preventer stack. The riser functions as casing and provides a conduit for mud circulation and isolation of the well from the sea. Whenever the well is "live" or capable of flowing, there is usually tubing between the floating vessel and the blow out preventer stack. This tubing will be inside the riser, if a riser is used. This tubing section is available for use as a lubricator section for insertion therethrough of wire or electric line equipment if a valve is provided therebelow. Use of the riser pipe as the lubricator section will eliminate use of an extending lubricator section above the floating vessel and will thereby eliminate the hazards involved in such use.

In view of the fact that the lubricator assembly must contain the well pressure while the equipment is inserted therethrough for subsequent utilization in the well, it is necessary to control the well pressure below the lubricator assembly during this procedure. This is achieved by use of a valve assembly within the lubricator section. Some commercial and prior art lubricators contain normally open valve assemblies which permit the valve to automatically open if hydraulic control pressure is lost. Under certain conditions, if control pressure were lost, a blow out might result. Other lubricator valve assemblies contain normally closed valve assemblies which permit the valve to automatically close if hydraulic control pressure is lost. Normally, closed valves can close and sever the wire or other line if control pressure is lost, possibly damaging the valve and rendering it inoperable, thereby causing a blow out of the well. Moreover, each of these types of prior art valve assemblies are somewhat disadvantageous in that they are not fail-safe, that is, the open or closed position of the valve is not affected by loss of control pressure.

The present lubricator valve assembly overcomes many of the disadvantages of the prior art apparatuses by providing a mechanism which utilizes a combination of pressure means to activate the valve element. Additionally, the present lubricator assembly provides means for locking the valve manipulating mechanism when the valve element is in closed position. The present lubricator and valve assembly are not automatically manipulated when control pressure is lost, which results in a fail-safe valve assembly. Moreover, the present lubricator assembly also provides a means for both reducing metallic friction on the ball valve surfaces during the opening and closing manipulating steps as well as providing a metal-to-metal seal when pressuring above the ball valve element.

A necessary function of this tool is the requirement that the tubing be pressured from the surface to re-open the valve. Pressure above the tool must exceed pressure below the tool before it will open, thus assuring control of the well by a pressure source above the lubricator.

SUMMARY OF THE INVENTION

The present invention provides a lubricator and valve assembly designed primarily for use in conjunction with the drilling, completion and workover of subterranean oil and gas wells at offshore locations. The valve assembly preferably contains a reciprocatable ball valve mechanism which is held in open position by mechanical means and is insensitive to tubing pressure. Application of first fluid means in the fluid control line acting on an activating mandrel will raise the mandrel, and, in turn, rotate the valve element to closed position. The lubricator valve apparatus also has mechanical locking means which will maintain the activiating mandrel in a locked position after the valve has been shifted to closed position, the locking mechanism being initially activated by longitudinal upward movement of the valve control mandrel. Second fluid pressure means within the tubing also are provided in the lubricator assembly whereby the valve control mandrel is released from the mechanical lock mechanism and the valve is reciprocated to open position. Valve metallic friction reducing means are also provided.

FIGS. *2a, 2b,* and *2c* are elongated views, in series, of the present lubricator assembly with the valve element shown in fully opened position, FIG. *2b* being a lower continuation of FIG. *2a,* and FIG. *2c* being a lower continuation of FIG. *2b.*

Figure 3:
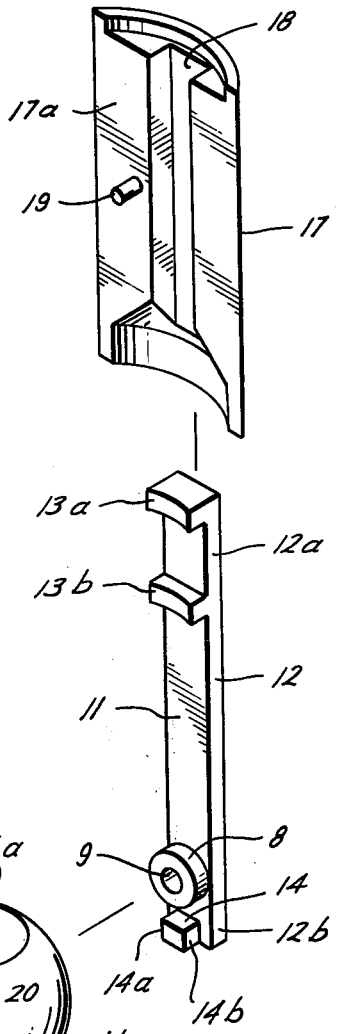

FIG. 3 is a series of views of the valve element and its immediate activating components comprising a valve control strap housing (upper view), a valve control strap (middle view), and the ball element (lower view).

Figure 1:
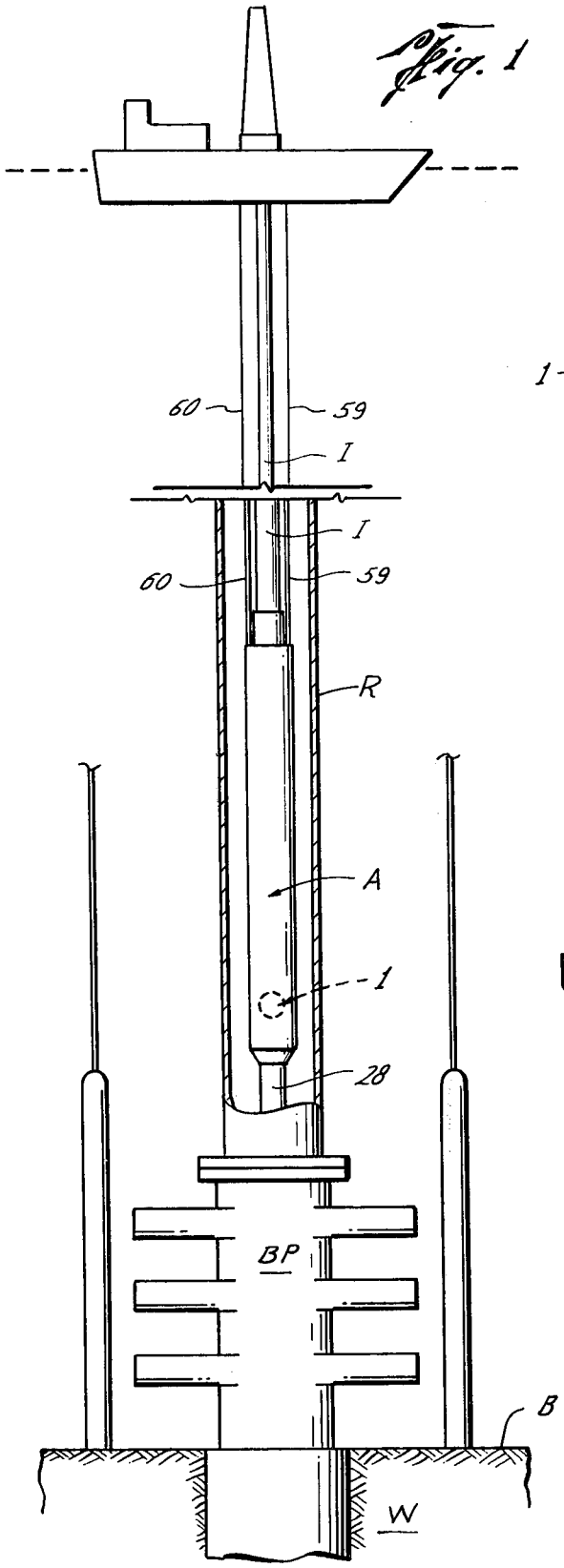
FIG. 1 is a schematic longitudinal view showing an offshore well location and the lubricator valve assembly made up as a part of the tubing string within a riser pipe above the well blowout preventer stack.
Figure 4A:
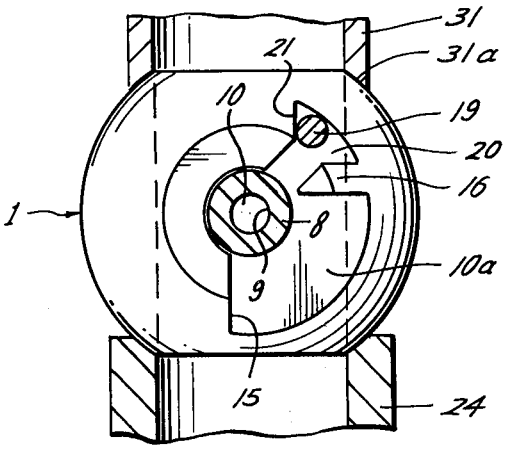
Figure 4:
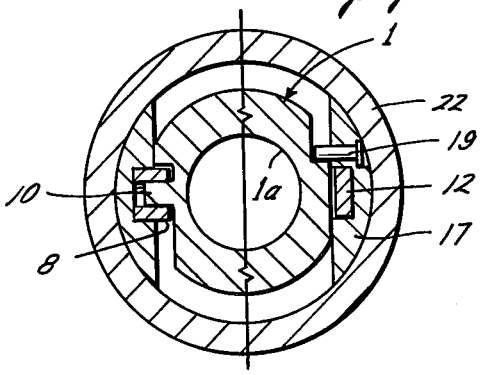

FIG. 4 is a cross-sectional detail taken along lines 4 — 4 of FIG. *2c,* showing the ball element within the lubricator assembly in opened position and its interrelation with the valve activating mechanism.

FIG. 4*a* is a partial side view of the valve and its activiating mechanism. The ball element is shown in open communication with flow passageways above and below the apparatus.

Figure 5A:
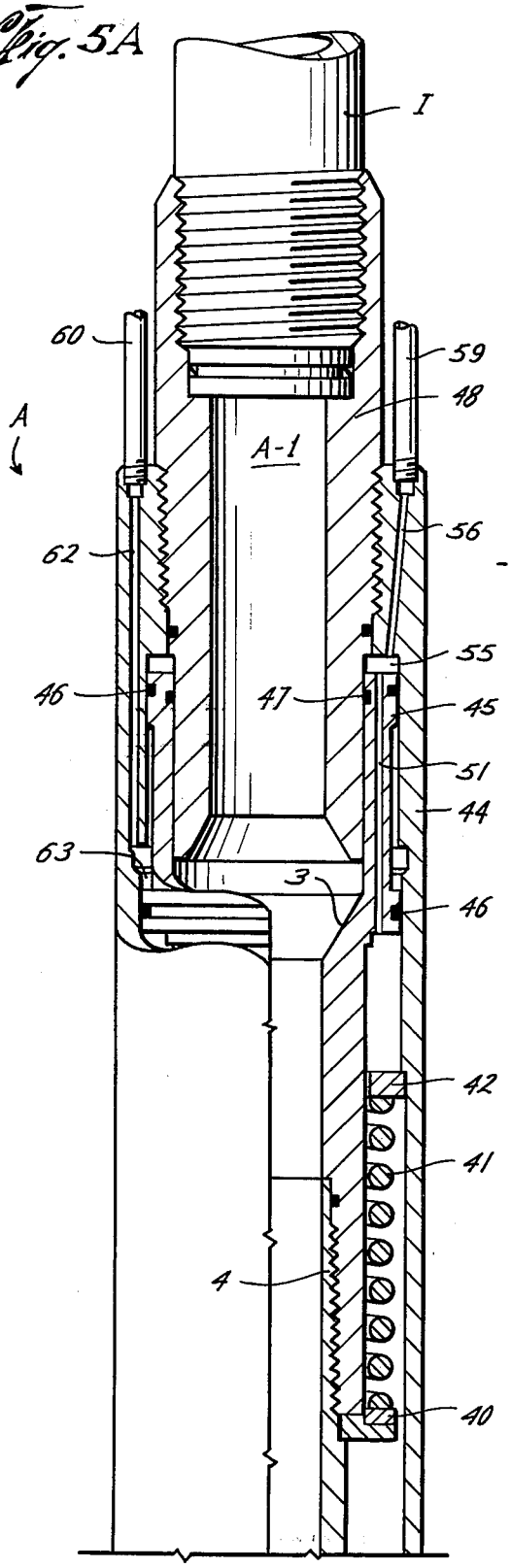
Figure 5B:
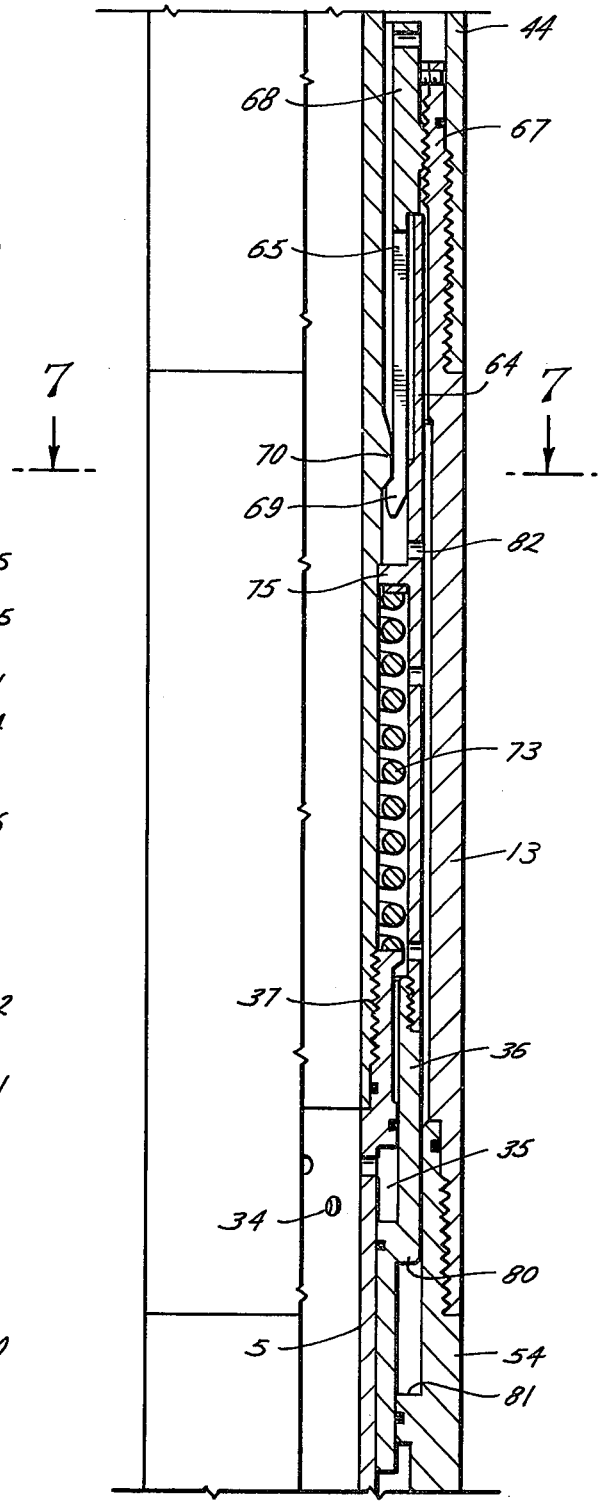

FIGS. 5*a*, 5*b*, and 5*c* are longitudinal views of the lubricator assembly with the ball element shown in closed position and the locking mechanism in activated state to prevent control line pressure activation of the ball element to open position, FIG. 5*b* being a lower continuation of FIG. 5*a*, and FIG. 5*c* being a lower continuation of FIG. 5*b*.

FIG. 6 is a cross-sectional view taken along lines 6 — 6 of FIG. 5*c* showing the ball element and its immediate operating mechanism, the valve element being shown in closed position.

Figure 6A:
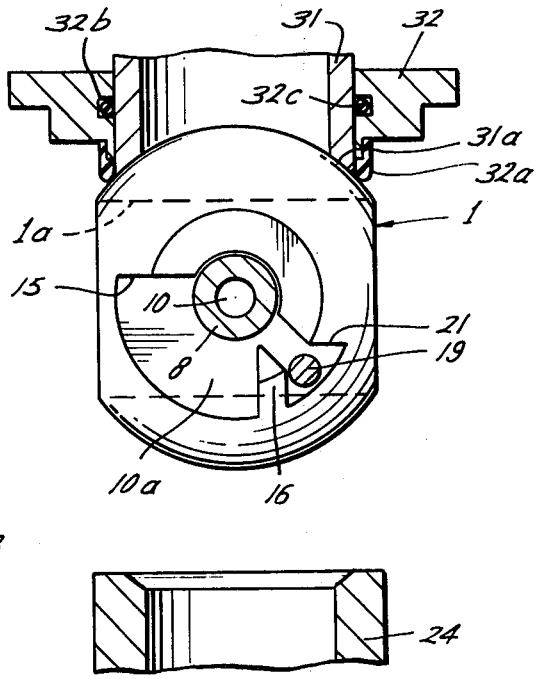

FIG. 6*a* is a partial side view of the valve and its activating mechanism, similar to the view shown in FIG. 4*a*, the valve mechanism being in closed position in relation to flow passageways above and below the apparatus.

FIG. 7 is a complete cross sectional view of the lubricator assembly taken along lines 7— 7 of FIG. 5*b*.

Figure 8:
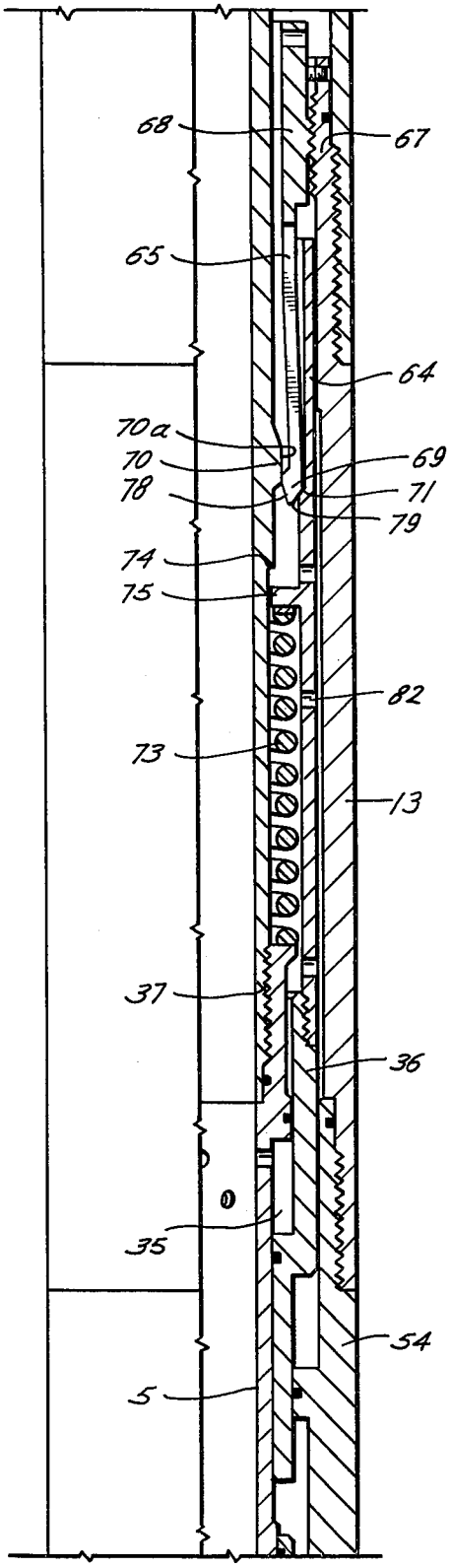

FIG. 8 is a longitudinal sectional view of the central section of the lubricator assembly showing the collet fingers of the lock mechanism sliding between companion locking surfaces on the valve control mandrel and the latch sleeve during relative longitudinal movement between the control mandrel and the latch sleeve.

Figure 9:
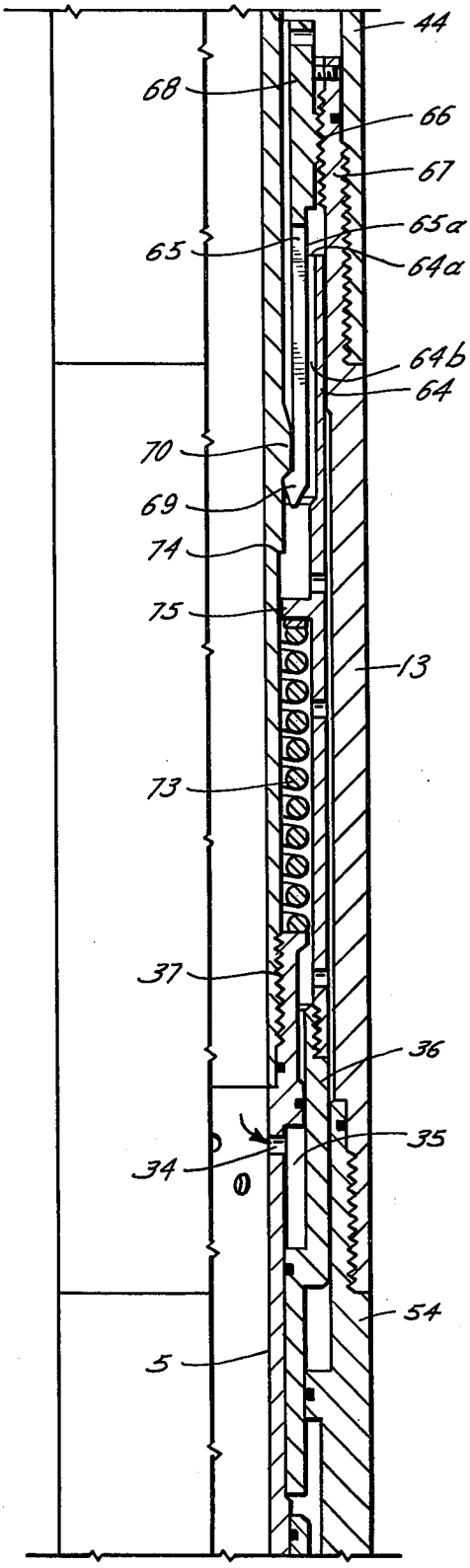

FIG. 9 is a view similar to that of FIG. 8 showing the lock sleeve in position to unlock the control mandrel, with tubing pressure entering the lock piston chamber for activation of the lock sleeve.

DESCRIPTION OF THE PREFERRED EMBODIMENTS

The lubricator valve apparatus A has a ball valve element 1 which is shifted from an open position to a closed position by longitudinal manipulation of a control mandrel mechanism 2 operatively comprising a ball piston element 3, an elongated lock mandrel member 4 affixed thereto, a lock piston mandrel 5 affixed to the lock mandrel member 4, and a thrust carriage element 6 engaged below the lock piston mandrel 5.

The ball valve element 1 and its immediate operative components are depicted in FIG. 3. As shown, the ball element 1 has a flow passageway 1*a* therethrough to permit communication of well and other fluids as well as tools, such as perforating guns, and the like, not shown. The internal diameter of the ball element as represented by the flow passageway 1*a* is substantially equivalent to the internal diameter of the control mandrel elements 2 thereabove and the bottom sub member 7 therebelow to provide a full opening valve element. The ball element 1 is manipulatively affixed to a companion control ring 8 having in its center a control seat 9 for housing of an exteriorally protruding control pin 10 on the valve element 1. The control ring 8 is affixed to the inner surface 11 of a longitudinally extending valve control strap 12 having at its upper end 12*a* a series of lock members 13*a* and 13*b* to assist in manipulation of the valve element 1, and a solid valve rotation stop member 14 on the control strap lower end 12*b* immediate and just below the control ring 8. The valve rotation stop 14 has primary and secondary surfaces 14*a* and 14*b* on each side thereof for limitation of the rotation of the ball element 1 during reciprocation. The primary surface 14*a* of the valve stop element 14 will engage a companion shoulder stop element 15 extending from a travel grooveway 10*a* formed around the control pin 10 on each side of the ball element 1. When the ball element 1 is manipulated to its closed position, the control pin 10 will rotate within the control ring 8. The ball element grooveway 10*a* will rotate with respect to the valve stop element until the secondary surface 14*b* engages the protruding thrust abutment 16 on the valve element 1, thereby preventing further rotation and reciprocation of the ball element 1.

The ball element 1 is operatively engaged within the valve control strap 12 when the control pin 10 is within its companion control slot 9, the valve rotation stop member 14 being within the ball element grooveway 10*a*. Additionally, the valve control strap 12 is operatively engaged within an exterior valve control strap housing member 17 having therein an engrooved longitudinal control strap receptacle 18 for receipt of the valve control strap 12. Protruding outwardly from the inner diameter surface 17*a* of the valve control strap housing 17 is a valve manipulating pin 19 for travel engagement within its companion manipulating slot 20 on the exterior surface of the ball element 1. As the valve control strap 12 is caused to be raised or lowered, the ball element 1 is rotated by the force exerted on the manipulating pin 19 and over the outwardly extending surface 21 of the slot 20.

The ball element 1, valve control strap 12 and control strap housing 17 are, in turn, housed within the apparatus A in a circumferentially extending elongated valve housing member 22 connected at its lower end by threads 23 to the bottom sub member 7, which, in turn, has at its upper end an upwardly protruding head 24 with a plurality of portal members 25 providing pressure passageways from the interior of the apparatus A to a pressure passage 26 immediate the head portion 24 of the bottom sub 7 and the valve control strap housing 17, for permitting pressure communication within the apparatus A during the re-opening sequence of the ball element 1, as described below. The bottom sub 7 is connected at its lower end by thread members 27 to a tubing section 28 which continues the tubing string downwardly through the well W. O-rings 29 are provided within their respective grooveways 29*a* on the bottom sub 7 and the upper portion 30 of the tubing element 28 to prevent fluid communication between the tubing section 28 and the bottom sub 7, and the bottom sub 7 and the valve housing 22, respectively.

The upper and lower outwardly extending carriage lock elements 13*a* and 13*b* of the valve control strap 12 are functionally engageable within a companion grooveway 13*a*[1] within the thrust carriage 6 and above an outwardly and circumferentially extending abutment 13*b*[1] upon the differential sleeve member 31, respectively. The differential sleeve 31 has protruding exteriorally therearound a retainer ring element 32 encapsulating at its lower end an elastomeric elongated seal member 32*a* for smooth engagement upon the outer smooth surface 1*b* of the ball element 1. Within the retainer ring 32 is a grooveway 32*b* for receipt of an O-ring 32*c* to prevent fluid communication between the retainer ring 32 and the differential sleeve member 31. The differential sleeve 31, which is a free-floating device, except when the valve is in the fully closed position, is operatively engaged by the valve control strap 12 to the thrust carriage 6 immediately thereabove which, in turn, is engaged by threads 33 to the lock piston mandrel 5 having at its upper end a series of pressure ports 34 for communication of fluid within the interior of the apparatus A and within a releasing piston pressure chamber 35 formed between the lock piston mandrel 5 and a releasing piston 36 outwardly encircling the immediate upper end thereof. The lock piston mandrel 5 is connected by threads 37 to the lock mandrel member 4 which, in turn, provides a partial internal housing for the locking device described below. The lock mandrel 4 is engaged at its upper end by threads 37' to the ball piston 3 having a grooveway **38*a* for receipt of the circumferentially extending O-ring 38 around the upper end of the lock mandrel 4 to prevent fluid communication between the ball piston 3 and the lock mandrel 4. The lower portion of the ball piston 3 provides an exteriorally protruding retainer stop member 39 having engaged on the top thereof a spring seat 40 engaging the lower end of a spring element 41 encircling the lower portion of the ball piston 3, the spring element 41 being encapsulated at its upper end by a companion spring seat 42 encircularly affixed around the ball piston 3 and held in place against upward travel by an outwardly extending and downwardly facing shoulder 43 formed on a control pressure housing 44** described in further detail below.

Forming the uppermost portion of the ball piston 3 is a longitudinally extending piston head 45 having a grooveway **46*a* for receipt of an O-ring 46 at its upper and lower ends to prevent fluid communication between the piston head 45 and the control pressure housing 44. A similar grooveway 47*a* for receipt of companion O-ring 47 also is provided upon the piston head 45 to prevent fluid communication between the piston head 45 and a top sub 48 when the piston head 45 slides along the outer and exterior surfaces 49*a* and 49*b* of the top sub 48, and control pressure housing 44 respectively, during operation. The piston head 45 has at its upper end a central opening 50 entering into a pressure passageway 51 extending longitudinally throughout the piston head 45, the passageway 51 terminating at a corresponding opening 52 at the lower end of the piston head 45 and communicating with a pressure chamber 52*a* formed therebelow by the lower end of the piston head 45, the inner wall 44*a* of the control pressure housing 44, the outer wall 3*a* of the ball piston 3, and continuing lowerly between the outer housing 13 of the apparatus A and the control mandrel components 2 until pressure communication resistance is afforded by operation of the O-rings within the control pressure housing 44, the lock piston housing 54, the releasing piston 36, the lock piston mandrel 5, and the lock mandrel 4**.

The piston head 45 and the passageway 51 therethrough communicate with an upper control pressure chamber 55 which, in turn, communicates with a control line duct 56 formed within the upper portion of the control pressure housing 44. A receiving groove 57 at the uppermost end of the control pressure housing 44 provides a means for engagement of the lower end 58 of a fluid control line 59 which extends upwardly and adjacent the exterior of the apparatus A to a control panel (not shown) on the ship deck, platform, or the like.

A reference vent line 60 extending from the control panel, of similar construction as the control line 59, is engaged within a companion receiving groove 61 therefor within the upper end of the control pressure housing 44 and at a point 90° from the receiving groove 57 for the control line 59 The reference vent line 60 communicates with a reference pressure duct 62 longitudinally and downwardly extending therefrom within the control pressure housing 44 and terminating at a lower port **62*a* which is in fluid communication with a reference pressure chamber 63 circumferentailly extending around the piston head 45 and within the upper portion of the control pressure housing 44**. The reference pressure system as described above will be operationally depicted in sequence below.

When the ball element 1 is in open position such that the flow passage **1*a* therein communicates with the interior passageway P and $P^1$ above and below the ball valve element 1, the apparatus A and the ball valve element 1** will not be activated until such time as control pressure in increased, thus initiating the ball closure cycle.

In association with the ball closure cycle is the function and operation of the locking system which prevents downward longitudinal movement of the lock mandrel 4 and its interconnecting and associated parts until such time as tubing pressure causes deactiviation of the locking system. The locking system of the present apparatus basically is comprised of a longitudinally extending tubular-like locking sleeve 64, the releasing piston 36 and a collet lock apparatus 65. Interconnected by threads 66 to an upwardly and inwardly extending box 67 on the control pressure housing 44 is a circumferentially extending locking latch mechanism 68 having an adjustment passage **68*a* extending laterally through its uppermost portion. At a lower end of the locking latch mechanism 68 and forming a part thereof are a plurality of flexible finger-like collet members 65, each member 65 having an inwardly protruding spoon element 69 at the end thereof for securable engagement within a companion upset 70 along the lock mandrel 4**.

Operationally interconnected with the locking latch mechanism 68 is the longitudinally extending tubular locking sleeve 64 open at its upper end **64*a* and receiving within its interior 64*b* the lock mandrel 4 and the locking latch mechanism 68. Along the inwardly facing interior surface 64*b* of the locking sleeve 64 and immediate the outwardly protruding upset 70 along the lock mandrel 4, when the ball element 1 is in its open position, is a slightly outwardly protruding shoulder 71 for cooperation with the upset 70 on the lock mandrel 4 to engage the outer surface 72 of the collect members 65 in order to resist downward longitudinal movement of the lock mandrel 4 after the ball element 1 has been reciprocated to its fully closed position. The lower section of the locking sleeve 64 serves an an outer housing for a spring 73, which is compressably encircled around the lower portion of the lock mandrel 4, the spring 73 urging the entire locking sleeve 64 in an upward direction, this force being resisted by an outwardly protruding shoulder 74 on the lock mandrel 4 which contacts a resistance block 75 extending from the locking sleeve 64 for engagement with the shoulder 74. A thrust bearing 76 is provided around and below the resistance block 75 for assembly of the spring 73**.

As will be described in further detail below and in operational sequence, when the ball element 1 is to be reciprocated to closed position, the lock mandrel 4 will be caused to travel upwardly. The force contained within the compressed spring 73 within the locking sleeve 64 will cause the locking sleeve 64 to travel upwardly. As the inner smooth surface 78 along the spoon 69 of the collect 65 contacts and travels along the upwardly sliding upset 70 on the lock mandrel 4, the collet elements 65 will expand outwardly, and the outwardly and slightly downwardly angled outer surface 79 on the spoon 69 will engage the smooth surface or shoulder 71 along the locking sleeve 4. This position is shown in FIG. 8.

As the lock mandrel 4 continues its upward travel, the shoulder surface 71 on the locking sleeve 4 will momentarily engage the surface 79 on the spoon 69 which affords resistance to further upward travel of the locking sleeve 64. Although the sleeve 64 is thus stabilized against longitudinal movement, the lock mandrel 4 continues upward travel with upset 70 passing upwardly against the surface 78 on spoon 69, until the upset 70 is completely above the surface 78 at which time the collet 65 is urged inwardly to its normally retracted position by the force exerted thereon by shoulder 71 engaging its companion surface 79. The force exerted by the 71, 79 interface will cause the collet elements 65 to collapse and pass under the upset 70 while the upward travel of the lock mandrel 4 continues. The shoulder 71 on the locking sleeve 64 is permitted to force the collet 65 to pass under the upset 70 by means of the upward urging of the locking sleeve 65 afforded by expansion of the spring element 73 as the locking sleeve 64 follows the upward travel of the lock mandrel 4.

When the collet 65 is in its locked position, as shown in FIG. 5*b*, the ball element 1 will be rotated to its completely closed position and, because of the downward longitudinal resistance afforded by the action of the collet 65 in conjunction with the lock mandrel 4, the lock mandrel 4 will be unable to travel downwardly to reopen the ball element 1.

A series of pressure passages 82 are provided laterally through the locking sleeve 64 to permit transmission of control fluids throughout the control pressure housing 44 immediate the spring 73.

Operatively associated with the locking mechanism of the present apparatus, and as means to reopen the ball element 1 after the lock mandrel 4 has been placed in its fully locked position, a releasing piston mechanism is provided which is initially activiated by increasing well tubing pressure within the tubing string I and the interior A-1 of the apparatus A to provide a differential over the well pressure within the pressure chamber areas of the apparatus A. Tubing pressure ports 34 circumferentially extend through the lock piston mandrel 5, which is attached by threads 37 to the lower end of the lock mandrel 4. A releasing piston 36 which is interconnected to the lower end of the locking sleeve 64 defines along its inner surface a piston pressure chamber 35 communicating with the ports 34. The releasing piston 36 being functionally interconnected with the locking sleeve 64, is limited in upward longitudinal travel by contact of the resistance block 75 with the outwardly protruding shoulder 74 along the inner surface of the lock mandrel 4, while resistance to downward longitudinal movement of the releasing piston 36 is afforded by an outwardly extending shoulder 80 thereon which may contact a companion shoulder 81 which extends outwardly along the lock piston housing 54.

As the pressure in the area $P^1$ is overcome by an increase in the pressure in the area P, differential pressure will cause the expansion of the piston chamber 35 immediate the releasing piston 36, and the releasing piston 36 with its interconnected locking sleeve 64 will be urged slightly downwardly, thus permitting the outwardly extending and upwardly facing shoulder 71 on the locking sleeve 64 to be disengaged from its companion surface 79 of the collect 65. In turn, the lock mandrel 4, which is urged downwardly by the operation of the ball spring element 41 circumferentially extending around the lower portion of the ball piston 3, is permitted to travel downwardly when the collect members 65 spring to their disengaged position and away from the upset 70 along the lock mandrel 4. With the collect elements 65 in disengaged position, the spring 41 surrounding the ball piston 3 will afford sufficient downward longitudinal movement to the lock mandrel 4 and its associated parts to rotate the ball element 1 to its fully open position.

Figure 2A:
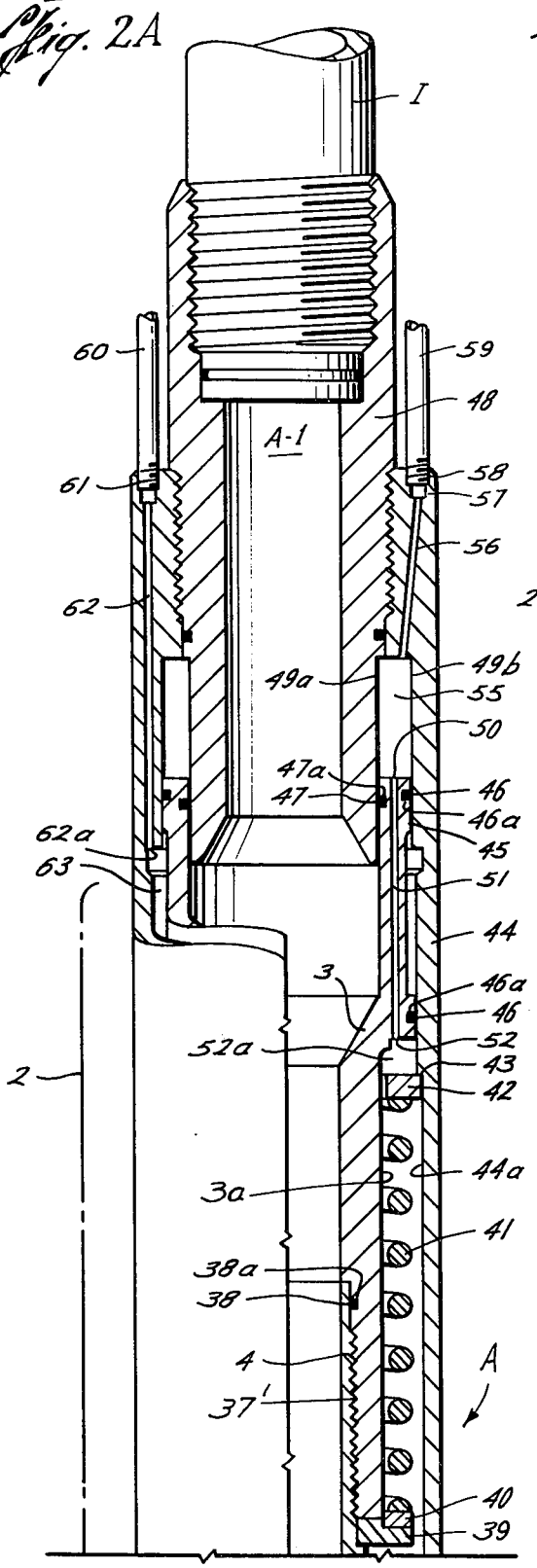
Figure 2B:
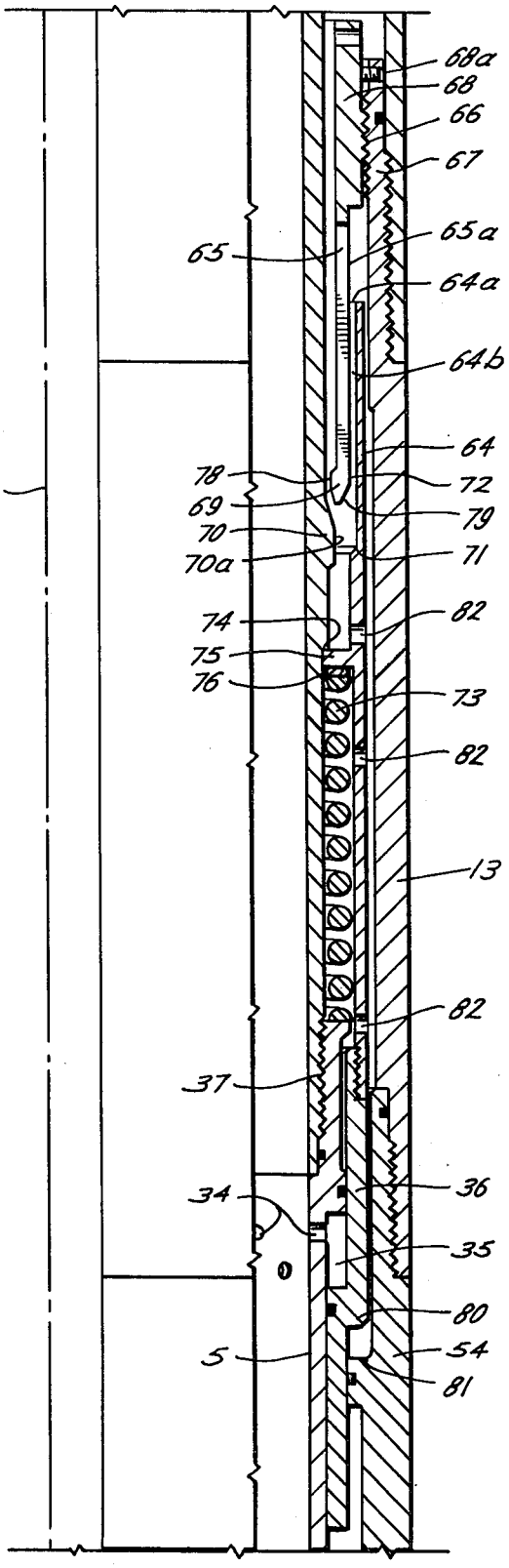
Figure 2C:
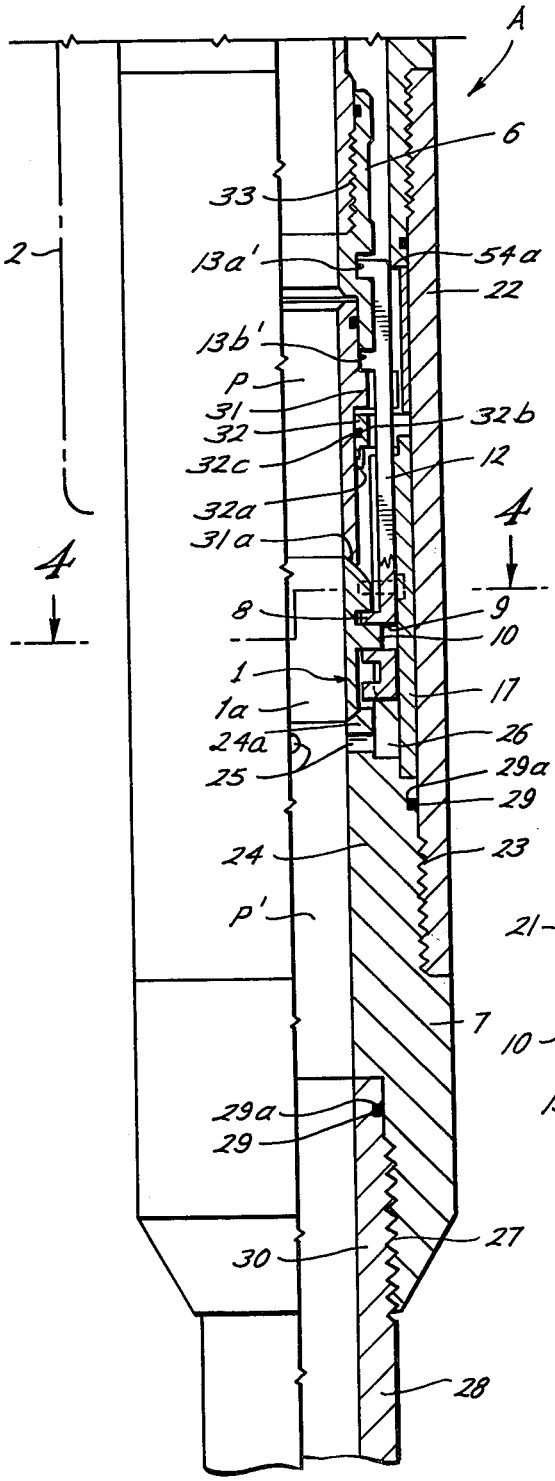

The lubricator apparatus A of the present invention is made up such that it is an integrable part of the tubing string I with sections of tubing string I being connected to it by threaded or other means. The tubing string I is inserted within the riser pipe R and through the blowout preventer B-P, the tubing string I extending through the sea bed B into the well W. The control and reference vent lines 59 and 60 extend from their respective receiving grooves 57 and 61, within the lubricator valve assembly A to a control panel (not shown) on the drill ship, platform, or the like, and the control line pressure is applied to the control line 59 to the lubricator apparatus, as shown in FIGS. 2*a*, 2*b* and 2*c*. As pressure is increased in the control line, pressure will act on the piston head 45 to cause the ball piston 3, the lock mandrel 4 interconnected therewith, the lock piston mandrel 5 therebelow, the thrust carriage 6 and the valve control strap 12 to move upwardly causing the manipulating pin 19 on the exterior 17*a* of the valve control strap housing 17 to travel within its companion manipulating groove 20 causing rotation of the ball element 1 until the secondary surface 14*b* on the valve stop 14 engages the thrust abutment 16 of the ball element 1, at which point the ball element 1 is in its completely closed position. When the ball element 1 is in its fully closed position, the ball control strap 12 is not the upstop for the ball because the floating differential sleeve 31 rises until it contacts the lower portion 54*a* of the lock piston housing 54. The differential sleeve 31 prohibits further longitudinal travel of the ball element 1, thereby providing a metal-to-metal seal between the differential sleeve 31 and the ball element 1. Additionally, the reference vent line 60, will confirm that the ball piston 3 and its interconnected parts have travelled longitudinally upwardly within the lubricator apparatus A, thus indicating and confirming activation of the tool to rotate the ball element 1 to its close position.

When it is desired to insert production or completion equipment within the tubing string I to perform functions such as perforating and the like, the ball element 1 is rotated to closed position and the tools are inserted through the tubing string I and the lubricator valve assembly A on a wireline, electric line, or the production string (not shown). The ball element 1 is rotated to its closed position by increasing control pressure, which, in turn, permits the ball piston 3, the lock mandrel 4, the lock piston mandrel 5, the thrust carriage 6 and the valve control strap 12 to travel upwardly. Repeated variations in control pressure will not affect the closed and locked position of the valve.

As noted above, in conjunction with the step of manipulating the ball element 1 to its fully closed position, there is provided a locking mechanism to insure that the ball element 1 is maintained in a fully and sealingly closed position. When the control line 59 pressure is applied, the lock mandrel 4 will travel upwardly and the upset 70 thereon will cause slight outward expansion of the collect elements 65 on the locking latch 68. As the upward travel of the lock mandrel 4 and ball piston 3 continues, the inner surface of the collet elements 65 will travel across the outwardly protruding surface 70*a* of the upset 70, and the collect elements 65 will be urged into a slightly retracted and locked position when the outer surface 65*a* of the collect elements 65 engages the outwardly protruding shoulder 71 along the locking sleeve 64 which will lock the collect 65 below the upset 70 in a position which will prevent downward movement of the lock mandrel 4. The outwardly extending shoulder 71 on the locking sleeve 64 maintains upward force upon the collect element 65 in conunction with the lock mandrel 4 by the force of the spring 73 housed within the locking sleeve 64. The upset 70 on the lock mandrel 4 is urged into locking position with the collet 65 and the locking sleeve 64 due to the force of the spring 73. Control pressure may be bled off and the valve will remain closed.

With the ball element 1 of the lubricator assembly A being rotated to its completely closed position, the well W is shut off therebelow, thus permitting pressure to be bled off above the lubricator, thereby allowing completion or other equipment to be made up within the lubricator section of the tubing string I in the riser Pipe R. After the equipment is made up on a secondary, production string, wire line, or the like, it will be necessary to reciprocate the ball element 1 to fully open position to pass the equipment through the lubricator assembly A and into the well W therebelow. With the lock mandrel 4 and its corresponding and associated parts being in locked position, activation of the ball element 1 to open position can only be accomplished by increasing pressure within the tubing area P to an excess of well pressure within the tubing area $P^1$, acting below the valve, thus providing differential pressure manipulation of the ball element 1 to open position. This assures well control because the tubing must be closed and pressure tight at the surface. Since the well pressure in area P will be greater than the tubing pressure acting within the area $P^1$ below the ball valve 1 during initial manipulation of the ball element 1 to open position, the differential sleeve 31 will be pressure activated into sealing engagement with the outer smooth surface 1*b* of the ball element 1 to permit the seat 31*a* of sleeve 31 to engage the ball element 1 and surface 1*b* and establish a pressure seal. Once the ball opens, the metal-to-metal seal is no longer pressure activated and the differential sleeve 31 is no longer in contact with the ball element 1. The differential sleeve 31 serves to prevent metallic friction between the surface 1*b* of the ball element 1 and the metallic surface at the end 31*a* of the differential sleeve 31 when the ball element 1 is being manipulated to open and closed positions. Additionally, the retainer ring 32 and elastomeric seal element 32*a* function in cooperation with the differential sleeve 31 to provide a rubber-to-metal seal when the well pressure in the area $P^1$ below the ball exceeds pressure above the ball element 1 in the area P.

In order to shift the ball element 1 from closed to open position, the tubing pressure in the area P is permitted to enter the releasing piston chamber 35 through the pressure ports 34 in the lock piston mandrel 5. As the pressure is increased over the static well pressure in the area $P^1$ the differential pressure in the releasing piston chamber 35 causes the releasing piston 36 and the locking sleeve 64 interconnected therewith to move longitudinally downwardly within the control pressure housing 44. As the locking sleeve 64 and the releasing piston 36 move downwardly, the spring 73 housed within the locking sleeve 64 is contracted and the outwardly protruding shoulder 71, which has engaged the collet member 65 to cooperate with the upset 70 to lockingly engage the mandrel 4, is caused to separate from its engaged surface 78 on the collet 65. As the locking sleeve 64 travels downwardly because of tubing pressure increase, the collet 65 will expand and the inner surface of its flexible elements will quickly travel over the outer longitudinal surface 70*a* of the upset member 70 on the lock mandrel 4. When the collet element 65 is disengaged from the upset member 72, the lock mandrel 4 and its companion activating elements will be urged downwardly by expansion of the spring 41 encircling the ball piston 3. The thrust carriage 6 which is affixed to the lock piston mandrel 5 urges the valve control strap 12 in a downward direction to, in turn, cause the manipulating pin 19 on the valve control strap housing 17 to travel within the manipulating groove 20 on the ball element 1 to rotate the ball element 1 to open position. Rotation of the ball element 1 continues automatically to the full open position because of the urging of the spring 41 until secondary surface 14*a* of the valve stop 14 engages the thrust abutment 16 on the surface 21 of the ball element 1. The downstop 24*a* stops longitudinal movement of the ball element 1 and its companion activating elements. When the ball piston 3 and its correspondingly operational parts are manipulated to rotate the ball element 1 to open position, the control fluid level will rise somewhat as the ball piston head 45 travels downwardly and the ball piston chamber 55 increases correspondingly. Thus, downward movement of the ball piston 3 can be detected at the drill ship or platform surface by a drop in pressure and fluid level in the indicators affixed to the reference vent line 60. Such a drop and decrease in fluid level and pressure would be indicative that the ball element 1 is in open position. Correspondingly, an increase in fluid level in the reference vent line 60 would signify that the ball piston 3 and its correspondingly interrelated components had been activated to rotate the ball element 1 to closed position.

From the above, it can be seen that a lubricator valve apparatus is provided which is placed into closed position by an increase in control line pressure. A decrease in control line pressure thereafter will not cause a reversal in the operational mode to reciprocate the ball element to open position. Additionally, closure of the ball element also activates a locking mechanism which will prevent manipulation of the ball element to open position by increasing control line pressure. In conjunction with each of the above features, there is provided a means for unlocking the ball element control mechanism and rotation of the ball element to open position by means of increasing tubing pressure within the apparatus. In conjunction with the utilization of tubing pressure to unlock and activate the ball element to open position, there is provided a friction reduction mechanism which provides a metal-to-metal seal upon increase of tubing pressure.

It can also be seen from the above that the lubricator apparatus of the present invention may be manipulated to open, closed, locked, and reopened positions without requirement of retrieval of the tool to the drill ship or platform for reactivation. This feature is accomplished by utilizing control line pressure and tubing pressure in sequential combinations.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. An apparatus for installation of drilling, completion, workover tools, or parts thereof for subsequent use in an oil or gas well and for control of fluids through said apparatus, comprising: valve means having a passageway therethrough for control of fluid transmission through said apparatus; first fluid activatable means for first shifting of said valve means to closed position; second fluid activatable means for second shifting of said valve means to open position; and means for mechanically locking said valve means in said closed position to prevent shifting of said valve means to said open position by operation of said first fluid means; said second fluid means being operational to unlock said valve means from said closed and locked position and to shift said valve means to said open position, said first and second fluid means and said means for locking said valve means being repeatedly and sequentially operational.

2. The apparatus of claim 1 wherein said first fluid activatable means comprises a longitudinally extending control mandrel operatively engaged to said valve means, means at the upper end of said mandrel defining a piston element, a receiving chamber for said piston element and communicable with a control fluid line extending from said apparatus to a control point thereabove, said control mandrel being operatively engageable at its lower end with said valve means to shift said valve means to open and closed positions.

3. The apparatus of claim 1 additionally comprising first and second control sleeves, piston means for longitudinal manipulation of one of said first and second control sleeves, said piston means having a piston head element slidable along at least a portion of one of said sleeves and connected to the other of said sleeves, means operatively associated with said first and second control sleeves for normally urging said longitudinally manipulated of said first and second control sleeves in a longitudinal direction to shift said valve means to at least one of the open and closed positions, said first and second control sleeves being manipulatively engageable to said valve means.

4. The apparatus of claim 1 wherein said means for mechanically locking said valve means in said closed position comprises companion engagement means on said first and second fluid activable means, a latch element longitudinally extendable within said engagement means, and means for shifting one of said engagement means over said latch means to prevent downward movement of said first fluid activatable means.

5. The apparatus of claim 1 further comprising means immediate the valve means for communicating pressure within and below the valve means during manipulation of said valve means to open position.

6. The apparatus of claim 1 further comprising a differential sleeve longitudinally movable above said valve element, said sleeve being sealingly engaged against the exterior of said valve element when said valve element is in closed position, said sleeve being sealingly disengageable from said valve element when said valve element is in open position, said sleeve being urged to sealing engagement position with said valve element in response to pressure differential across the valve element, said sleeve being in frictionless relationship with said valve means in absence of pressure differential across said valve means.

7. The apparatus of claim 1 additionally comprising reference pressure operated means for rendering said apparatus insensitive to hydrostatic pressure at the depth of the operation of said apparatus, said reference pressure operated means further enabling control pressure to shift said valve means operatively independent of well pressure.

8. The apparatus of claim 7 wherein the reference pressure operated means comprises a reference pressure chamber immediate said first fluid activatable means and operatively responsive to longitudinal movement of said first fluid activatable means.

9. The apparatus of claim 8 wherein said reference pressure chamber is communicable with the top surface of said well by vent line means extending from said chamber to said well top surface.

10. An apparatus for installation of drilling, completion, workover tools or parts thereof for subsequent use in an oil or gas well and for control of fluid through said apparatus comprising: a housing having means at each end thereof for connection of said apparatus to a tubing string extending from the top surface of the well, said apparatus becoming an integral part of said tubing string, said housing defining a fluid passageway through said apparatus and communicating with a complimentary fluid passageway within said tubing string, valve means within said apparatus for control of fluid through said apparatus within said passageway, means for manipulating said valve means to one of open and closed positions, first fluid activatable means for activating said means for manipulating said valve means, mechanical locking means carried by said housing and engageable with said means for manipulating said valve means, and sleeve means within said housing and immediate said means for manipulating said valve means for coengagement with said locking means, said valve means being in open position upon longitudinal activation of said manipulating means, said valve being placed in closed position by a second longitudinal movement of said manipulating means, said locking means, said sleeve and said manipulating means being thereafter in engaged position to prevent reopening of said valve means by said first fluid activatable means, said valve means thereafter being placed in open position by second fluid activatable means for shifting said sleeve to disengaged position and longitudinally moving said manipulating means to open said valve means.

11. The apparatus of claim 10 wherein the means for reciprocating said valve means comprises: a longitudinally extending control mandrel operatively engaged with said valve means, means at the upper end of said mandrel defining a piston element, a receiving chamber for said piston element and communicable with a control fluid line extending from said apparatus to a control point thereabove, said control mandrel being operatively engageable at its lower end with said valve means to shift said valve means to open and closed positions.

12. The apparatus of claim 10 additionally comprising means for continuous urging of said manipulating means away from said valve means and means for continuously urging said locking sleeve longitudinally to locking position.

13. The apparatus of claim 10 additionally comprising piston means responsive to increase in tubing pressure within the tubing string and the apparatus for longitudinal manipulation of said locking sleeve to shift said sleeve and release said locking mechanism from engaged position when said valve means is in closed position, said piston means being longitudinally responsive to differential pressure across said valve means.

14. The apparatus of claim 10 further comprising a differential sleeve longitudinally movable above said valve element, said sleeve being sealingly engageable against the exterior of said valve element when said valve element is in closed position, said sleeve being sealingly disengageable from said valve element when said valve element is in open position, said sleeve being urged to sealing engagement position with said valve element in response to pressure differential across the valve element, said sleeve being in frictionless relationship with said valve means in absence of pressure differential across said valve means.

15. The apparatus of claim 10 additionally comprising reference pressure operated means for rendering said apparatus insensitive to hydrostatic pressure at the depth of the operation of said apparatus, said reference pressure operated means further enabling control pressure to shift said valve means operatively independent of well pressure.

16. The apparatus of claim 15 wherein the reference pressure operated means comprises a reference pressure chamber immediate said manipulating means and operatively responsive to longitudinal movement of said manipulating means.

17. The apparatus of claim 16 wherein said reference pressure chamber is communicable with the top surface of said well by vent line means extending from said chamber to said well top surface.

18. A lubricator assembly for use in conjunction with the drilling, completion or workover of a subterranean well, said lubricator assembly extendable within a well riser pipe, said assembly connectable to a tubing string extendable through the riser pipe for control of well pressure within said tubing string while drilling, completion, or workover tools and parts thereof are inserted within said tubing string and said lubricator assembly for subsequent insertion into said well, said lubricator assembly comprising: a housing connectable to said tubing string and defining a fluid passageway through said assembly, said passageway communicating with a complementary fluid passageway within said tubing string, valve means within said assembly for selective control to fluid through said assembly within said passageway of said assembly, means for reciprocating said valve means to one of open and closed positions, first fluid activatable means for activating said means for manipulating said valve means, mechanical locking means carried by said housing and engageable with said means for reciprocating said valve means, and sleeve means within said housing and immediate said means for reciprocating said valve means for coengagement with said locking means, said valve means being in open position upon a first longitudinal activation of said manipulating means, said valve means being placed in closed position by a second longitudinal movement of said manipulating means, said locking means, said sleeve and said manipulating means being thereafter in engaged position to prevent reopening of said valve means by said first fluid activatable means, said valve means thereafter being placed in open position by second fluid activatable means for shifting said sleeve to disengaged position and longitudinally moving said manipulating means to open said valve means, said valve means being movable to sealingly closed position to prevent well pressure therebelow from being transmitted through said passageway in said assembly and said tubing string above said valve means while said tools and parts thereof are being inserted within said assembly and said tubing string, said valve means being shiftable to open position to permit insertion of said tools and parts thereof through said assembly and to said well therebelow.

19. A lubricator assembly for use in conjunction with the drilling, completion or workover of a subterranean well, said assembly being communicable with a tubing string extendable within said well, tools for use during drilling, completion, or workover operations of said well being insertable within said tubing string and said lubricator assembly for subsequent insertion into said well, said lubricator assembly comprising: a housing connectable to said tubing string and defining a fluid passageway through said assembly, said passageway communicating with a complementary fluid passageway within said tubing string, valve means within said assembly for selective control of fluid through said assembly within said passageway of said assembly, means for reciprocating said valve means to one of open and closed positions, first fluid activatable means for activating said means for manipulating said valve means, mechanical locking means carried by said housing and engageable with said means for reciprocating said valve means, and sleeve means within said housing and immediate said means for reciprocating said valve means for coengagement with said locking means, said valve means being in open position upon a first longitudinal activation of said manipulating means, said valve means being placed in closed position by a second longitudinal movement of said manipulating means, said locking means, said sleeve and said manipulating means being thereafter in engaged position to prevent reopening of said valve means by said first fluid activatable means, said valve means thereafter being placed in open position by second fluid activatable means for shifting said sleeve to disengaged position and longitudinally moving said manipulating means to open said valve means, said valve means being movable to sealingly closed position to prevent well pressure therebelow from being transmitted through said passageway in said apparatus and said tubing string above said valve means while said tools and parts thereof are being inserted within said apparatus and said tubing string, said valve means being shiftable to open position to permit insertion of said tools and parts thereof through said apparatus and to said well therebelow.

20. A valve apparatus comprising: a housing; valve means comprising a valve seat and a valve head within said housing, said valve head being shiftable with relation to said seat, said valve means having a passageway therethrough for control of fluid transmission through said apparatus; first fluid activatable means for first shifting of said valve means to closed position; second fluid activatable means for second shifting of said valve means to open position; and means for mechanically locking said valve means in said closed position to prevent shifting of said valve means to said open position by operation of said first fluid means; said second fluid means being operational to unlock said valve means from said closed and locked position and to shift said valve means to said open position; said first and second fluid means and said means for locking said valve means being repeatably and sequentially operational.

21. The apparatus of claim 20 wherein said first fluid activatable means comprises a longitudinally extending control mandrel operatively engaged to said valve means, means at the upper end of said mandrel defining a piston element, a receiving chamber for said piston element and communicable with a control fluid line extending from said apparatus to a control point thereabove, said control mandrel being operatively engageable at its lower end with said valve means to shift said valve means to open and closed positions.

22. The apparatus of claim 20 additionally comprising first and second control sleeves, piston means for longitudinal manipulation of one of said first and second control sleeves, said piston means having a piston head element slidable along at least a portion of one of said sleeves and connected to the other of said sleeves, means operationally associated with said first and second control sleeves for normally urging said longitudinally manipulated of said first and second control sleeves in a longitudinal direction to shift said valve means to at least one of open and closed positions, one of said first and second control sleeves being manipulatively engageable to said valve means.

23. The apparatus of claim 20 wherein said means for mechanically locking said valve means in said closed position comprises companion engagement means on said first and second fluid activatable means, a latch element longitudinally extendable within said engagement means, and means for shifting one of said engagement means over said latch element to prevent downward movement of said first fluid activatable means.

24. The apparatus of claim 20 further comprising means immediate the valve means for communicating pressure within and below the valve means during the manipulation of said valve means to said open position.

25. The apparatus of claim 20 further comprising a differential sleeve longitudinally movable within said housing and above said valve element, said sleeve being sealingly engaged against the exterior of said valve element when said valve element is in said closed position, said sleeve being sealingly disengageable from said valve element when said valve element is in open position, said sleeve being urged to sealing engagement position with said valve element in response to pressure differential across the valve element, said sleeve being in frictionless relationship with said valve means in absence of pressure differential across said valve means.

26. The apparatus of claim 20 additionally comprising reference pressure operated means for rendering said apparatus insensitive to hydrostatic pressure at the depth of operation of said apparatus, said reference pressure operated means further enabling control pressure to shift said valve means operatively independent of well pressure.

27. A valve assembly comprising: a housing defining a fluid passageway therethrough, valve means within said apparatus for control of fluid flowable through said housing within said passageway, means for manipulating the said valve means to one of open and closed positions, first fluid activatable means for activating said means for manipulating said valve means, mechanical locking means carried by said housing and engageable with said means for manipulating said valve means, and sleeve means within said housing and immediate said means for manipulating said valve means for coengagement with said locking means, said valve means being placed in open position upon longitudinal activation of said manipulating means, said valve means being placed in closed position by a second longitudinal movement of said manipulating means, said locking means, said sleeve and said manipulating means being thereafter in engaged position to prevent reopening of said valve means by said first fluid activatable means, said valve means thereafter being placed in open position by second fluid activatable means for shifting said sleeve to disengaged position and longitudinally moving said manipulating means to open said valve means.

28. The apparatus of claim 27 further comprising a differential sleeve for reduction of metallic friction, said sleeve being longitudinally movable above said valve element, said sleeve being sealingly engageable against the exterior of said valve element when said valve element is in closed position, said sleeve being sealingly disengageable from said valve element when said valve element is in open position said sleeve being urged to sealing engagement position with said valve element in response to pressure differential across the valve element, said sleeve being in frictionless relationship with said valve means in absence of pressure differential across said valve means.

29. An apparatus for installation of drilling, completion, workover tools, or parts thereof for subsequent use in an oil or gas well and for control of fluids through said apparatus, said apparatus being operatively associatable with tubing pressure thereabove, said apparatus comprising; valve means having a passageway therethrough for control of fluid transmission through said apparatus; first fluid activatable means for first shifting of said valve means to closed position; second fluid activatable means for second shifting of said valve means to open position; and means for locking said valve means in said closed position to prevent shifting of said valve means to said open position by operation of said first fluid means; said second fluid means being operational to unlock said valve means from said closed and locked position and to shift said valve means to said open position, said first and second fluid means and said means for locking said valve means being repeatably and sequentially operational, one of said first and second fluid activatable means being operable by said tubing pressure.

30. The apparatus of claim 29 wherein said first fluid activatable means comprises a longitudinally extending control mandrel operatively engaged to said valve means, means at the upper end of said mandrel defining a piston element, a receiving chamber for said piston element and communicable with a control fluid line extending from said apparatus to a control point thereabove, said control mandrel being operatively engageable at its lower end with said valve means to shift said valve means to open and closed positions.

31. The apparatus of claim 29 additionally comprising first and second control sleeves, piston means for longitudinal manipulation of one of said first and second control sleeves, said piston means having a piston head element slidable along at least a portion of one of said sleeves and connected to the other of said sleeves, means operatively associated with said first and second lubricator assembly for subsequent insertion into said well, said lubricator assembly comprising: a housing connectable to said tubing string and defining a fluid passageway through said assembly, said passageway communicating with a complementary fluid passageway within said tubing string, valve means within said assembly for selective control of fluid through said assembly within said passageway of said assembly, means for reciprocating said valve means to one of open and closed positions, first fluid activatable means for activating said means for manipulating said valve means, mechanical locking means carried by said housing and engageable with said means for reciprocating said value means, and sleeve means within said housing and immediate said means for reciprocating said valve means for coengagement with said locking means, said valve means being in open position upon a first longitudinal activation of said manipulating means, said valve means being placed in closed position by a second longitudinal movement of said manipulating means, said locking means, said sleeve and said manipulating means being thereafter in engaged position to prevent reopening of said valve means by said first fluid activatable means, said valve means thereafter being placed in open position by second fluid activatable means for shifting said sleeve to disengaged position and longitudinally moving said manipulating means to open said valve means, said valve means being movable to sealingly closed position to prevent well pressure therebelow from being transmitted through said passageway in said assembly and said tubing string above said valve means while said tools and parts thereof are being inserted within said assembly and said tubing string, said valve means being shiftable to open position to permit insertion of said tools and parts thereof through said assembly and to said well therebelow, one of said first and second fluid activatable means being operable by pressurizing said tubing string.

46. A lubricator assembly for use in conjunction with the drilling, completion or workover of a subterranean well, said assembly being communicable with a pressurizable tubing string extendable within said well, tools for use during drilling, completion, or workover operations of said well being insertable within said tubing string and said lubricator assembly for subsequent insertion into said well, said lubricator assembly comprising: a housing connectable to said tubing string and defining a fluid passageway through said assembly, said passageway communicating with a complementary fluid passageway within said tubing string, valve means within said assembly for selective control of fluid through said assembly within said passageway of said assembly, means for reciprocating said valve means to one of open and closed positions, first fluid activatable means for activating said means for manipulating said valve means, mechanical locking means carried by said housing and engageable with said means for reciprocating said valve means, and sleeve means within said housing and immediate said means for reciprocating said valve means for coengagement with said locking means, said valve means being in open position upon a first longitudinal activation of said manipulating means, said valve means being placed in closed position by a second longitudinal movement of said manipulating means, said locking means, said sleeve and said manipulating means being thereafter in engaged position to prevent reopening of said valve means by first fluid activatable means, said valve means thereafter being placed in open position by second fluid activatable means for shifting said sleeve to disengaged position and longitudinally moving said manipulating means to open said valve means, said valve means being movable to sealingly closed position to prevent well pressure therebelow from being transmitted through said passageway in said apparatus and said tubing string above said valve means while said tools and parts thereof are being inserted within said apparatus and said tubing string, said valve means being shiftable to open position to permit insertion of said tools and parts thereof through said apparatus and to said well therebelow, one of said first and second fluid activatable means being operable by pressurizing said tubing string.

47. A valve apparatus selectively responsive to tubing pressure increase, said valve assembly comprising: a housing; valve means comprising a valve seat and a valve head within said housing, said valve head being shiftable with relation to said seat, said valve means having a passageway therethrough for control of fluid transmission through said apparatus; first fluid activatable means for first shifting of said valve means to closed position; second fluid activatable means for second shifting of said valve means to open position; and means for mechanically locking said valve means in said closed position to prevent shifting of said valve means to said open position by operation of said first fluid means; said second fluid means being operational to unlock said valve means from said closed and locked position and to shift said valve means to said open position; said first and second fluid means and said means for locking said valve means being repeatably and sequentially operational, one of said first and second fluid activatable means being selectively responsive to increase in tubing pressure.

48. The apparatus of claim 47 wherein said first fluid activatable means comprises a longitudinally extending control mandrel operatively engaged to said valve means, means at the upper end of said mandrel defining a piston element, a receiving chamber for said piston element and communicable with a control fluid line extending from said apparatus to a control point thereabove, said control mandrel being operatively engageable at its lower end with said valve means to shift said valve means to open and closed positions.

49. The apparatus of claim 47 additionally comprising first and second control sleeves, piston means for longitudinal manipulation of one of said first and second control sleeves, said piston means having a piston head element slidable along at least a portion of one of said sleeves and connected to the other of said sleeves, means operationally associated with said first and second control sleeves for normally urging said longitudinally manipulated of said first and second control sleeves in a longitudinal direction to shift said valve means to at least one of open and closed positions, one of said first and second control sleeves being manipulatively engageable to said valve means.

50. The apparatus of claim 47 wherein said means for mechanically locking said valve means in said closed position comprises companion engagement means on said first and second fluid activatable means, a latch element longitudinally extendable within said engagement means, and means for shifting one of said engagement means over said latch element to prevent downward movement of said first fluid activatable means.

51. The apparatus of claim 47 further comprising a differential sleeve longitudinally movable within said control sleeves for normally urging said longitudinally manipulated of said first and second control sleeves in a longitudinal direction to shift said valve means to at least one of the open and closed positions, said first and second control sleeves being manipulatively engageable to said valve means.

32. The apparatus of claim 29 wherein said means for mechanically locking said valve means in said closed position comprises companion engagement means on said first and second fluid activable means, a latch element longitudinally extendable within said engagement means, and means for shifting one of said engagement means over said latch means to prevent downward movement of said first fluid activatable means.

33. The apparatus of claim 29 further comprising a differential sleeve longitudinally movable above said valve element, said sleeve being sealingly engaged against the exterior of said valve element when said valve element is in closed position, said sleeve being sealingly disengageable from said valve element when said valve element is in open position, said sleeve being urged to sealing engagement position with said valve element in response to pressure differential across the valve element, said sleeve being in frictionless relationship with said valve means in absence of pressure differential across said valve means.

34. The apparatus of claim 29 additionally comprising reference pressure operated means for rendering said apparatus insensitive to hydrostatic pressure at the depth of the operation of said apparatus, said reference pressure operated means further enabling control pressure to shift said valve means operatively independent of well pressure.

35. The apparatus of claim 34 wherein the reference pressure operated means comprises a reference pressure chamber immediate said first fluid activatable means and operatively responsive to longitudinal movement of said first fluid activatable means.

36. The apparatus of claim 35 wherein said reference pressure chamber is communicable with the top surface of said well by vent line means extending from said chamber to said well top surface.

37. An apparatus for installation of drilling, completion, workover tools or parts thereof for subsequent use in an oil or gas well and for control of fluid through said apparatus, said apparatus being operatively associatable with tubing pressure thereabove, said apparatus comprising a housing having means at each end thereof for connection of said apparatus to a tubing string extending from the top surface of the well, said apparatus becoming an integral part of said tubing string, said housing defining a fluid passageway through said apparatus and communicating with a complimentary fluid passageway within said tubing string, valve means within said apparatus for control of fluid through said apparatus within said passageway, means for manipulating said valve means to one of open and closed positions, first fluid activatable means for activating said means for manipulating said valve means, locking means carried by said housing and engageable with said means for manipulating said valve means, and sleeve means within said housing and immediate said means for manipulating said valve means for coengagement with said locking means, said valve means being in open position upon longitudinal activation of said manipulating means, said valve being placed in closed position by a second longitudinal movement of said manipulating means, said locking means, said sleeve and said manipulating means being thereafter in engaged position to prevent reopening of said valve means by said first fluid activatable means, said valve means thereafter being placed in open position by second fluid activatable means for shifting said sleeve to disengaged position and longitudinally moving said manipulating means to open said valve means, one of said first and second fluid activatable means being operable by said tubing pressure.

38. The apparatus of claim 37 wherein the means for reciprocating said valve means comprises: a longitudinally extending control mandrel operatively engaged with said valve means, means at the upper end of said mandrel defining a piston element, a receiving chamber for said piston element and communicable with a control fluid line extending from said apparatus to a control point thereabove, said control mandrel being operatively engageable at its lower end with said valve means to shift said valve means to open and closed positions.

39. The apparatus of claim 37 additionally comprising means for continuous urging of said manipulating means away from said valve means and means for continuously urging said locking sleeve longitudinally to locking position.

40. The apparatus of claim 37 additionally comprising piston means responsive to increase in tubing pressure within the tubing string and the apparatus for longitudinal manipulation of said locking sleeve to shift said sleeve and release said locking mechanism from engaged position when said valve means is in closed position, said piston means being longitudinally responsive to differential pressure across said valve means.

41. The apparatus of claim 37 further comprising a differential sleeve longitudinally movable above said valve element, said sleeve being sealingly engageable against the exterior of said valve element when said valve element is in closed position, said sleeve being sealingly disengageable from said valve element when said valve element is in open position, said sleeve being urged to sealing engagement position with said valve element in response to pressure differential across the valve element, said sleeve being in frictionless relationship with said valve means in absence of pressure differential across said valve means.

42. The apparatus of claim 37 additionally comprising reference pressure operated means for rendering said apparatus insensitive to hydrostatic pressure at the depth of the operation of said apparatus, said reference pressure operated means further enabling control pressure to shift said valve means operatively independent of well pressure.

43. The apparatus of claim 42 wherein the reference pressure operated means comprises a reference pressure chamber immediate said manipulating means and operatively responsive to longitudinal movement of said manipulating means.

44. The apparatus of claim 43 wherein said reference pressure chamber is communicable with the top surface of said well by vent line means extending from said chamber to said well top surface.

45. A lubricator assembly for use in conjunction with the drilling, completion or workover of a subterranean well, said lubricator assembly extendable within a well riser pipe, said assembly connectable to a pressurizable tubing string extendable through the riser pipe for control of well pressure within said tubing string while drilling, completion, or workover tools and parts thereof are inserted within said tubing string and said housing and above said valve element, said sleeve being sealingly engaged against the exterior of said valve element when said valve element is in said closed position, said sleeve being sealingly disengageable from said valve element when said valve element is in open position, said sleeve being urged to sealing engagement position with said valve element in response to pressure differential across the valve element, said sleeve being in frictionless relationship with said valve means in absence of pressure differential across said valve means.

52. The apparatus of claim 47 additionally comprising reference pressure operated means for rendering said apparatus insensitive to hydrostatic pressure at the depth of operation of said apparatus, said reference pressure operated means further enabling control pressure to shift said valve means operatively independent of well pressure.

53. A valve assembly selectively responsive to tubing pressure increase, said valve assembly comprising: a housing defining a fluid passageway therethrough, valve means within said apparatus for control of fluid flowable through said housing within said passageway, means for manipulating the said valve means to one of open and closed position, first fluid activatable means for activating said means for manipulating said valve means, locking means carried by said housing and engageable with said means for manipulating said valve means, and sleeve means within said housing and immediate said means for manipulating said valve means for coengagement with said locking means, said valve means being placed in open position upon longitudinal activation of said manipulating means, said valve means being placed in closed position by a second longitudinal movement of said manipulating means, said locking means, said sleeve and said manipulating means being thereafter in engaged position to prevent reopening of said valve means by said first fluid activatable means, said valve means thereafter being placed in open position by second fluid activatable means for shifting said sleeve to disengage position and longitudinally moving said manipulating means to open said valve means, one of said first and second fluid activatable means being operable by said tubing pressure.

54. The apparatus of claim 53 further comprising a differential sleeve for reduction of metallic friction, said sleeve being longitudinally movable above said valve element, said sleeve being sealingly engageable against the exterior of said valve element when said valve element is in closed position, said sleeve being sealingly disengageable from said valve element when said valve element is in open position said sleeve being urged to sealing engagement position with said valve element in response to pressure differential across the valve element, said sleeve being in frictionless relationship with said valve means in absence of pressure differential across said valve means.

* * * * *